United States Patent [19]

Stanke et al.

[11] 3,971,092

[45] July 27, 1976

[54] APPARATUS FOR CLEANING THE SEALING SURFACES OF COKE OVEN DOORS AND DOOR JAMBS

[75] Inventors: Walter Stanke; Gottfried Mertens, both of Essen, Germany

[73] Assignee: Heinrich Koppers Gesellschaft mit beschrankter Haftung, Essen, Germany

[22] Filed: Aug. 28, 1974

[21] Appl. No.: 501,298

[30] Foreign Application Priority Data

Dec. 1, 1965 Germany ..... 2345212

[52] U.S. Cl. ..... 15/93 A; 202/241

[51] Int. Cl.[2] ..... C10B 43/04

[58] Field of Search ..... 15/93 A, 21 R, 21 D, 15/49 R, 49 C, 50 R, 50 C, 93 R, 93 A, 98; 51/180; 202/241

[56] References Cited

UNITED STATES PATENTS

| | | | |
|---|---|---|---|
| 2,559,295 | 7/1951 | Grossenbacher | 51/180 X |
| 3,015,913 | 1/1962 | Anderson, Sr. | 51/180 X |
| 3,056,699 | 10/1962 | Randell et al. | 15/93 A X |
| 3,146,475 | 9/1964 | Balitsky et al. | 15/93 A X |
| 3,741,806 | 6/1973 | Stanke et al. | 15/93 A X |

FOREIGN PATENTS OR APPLICATIONS

| | | | |
|---|---|---|---|
| 1,027,162 | 4/1966 | United Kingdom | 15/93 A |

*Primary Examiner*—Edward L. Roberts
*Attorney, Agent, or Firm*—Stanley J. Price, Jr.; John M. Adams

[57] ABSTRACT

The apparatus for cleaning the horizontal sealing surface of the coke oven door includes a cleaning tool that is arranged to move horizontally on a tool support. The tool support is movably connected to the frame member and is arranged to be adjusted vertically to clean the horizontal surface of the coke oven doors having different vertical dimensions. Stop members are provided on the tool support and the frame to control the vertical adjusted position of the cleaning tool. The apparatus also includes cleaning tools for cleaning the vertical edges of the coke oven door. The latter cleaning tools are mounted on a rotary column which, in turn, is supported on the frame member. Pairs of cleaning tools are connected to the rotary column and are arranged to clean the vertical surfaces of coke oven doors having different transverse dimensions. There are also provided other cleaning tools mounted on rotary columns for cleaning the refractory lining of the coke oven door. Pairs of the cleaning tools are arranged on the rotary column to clean the vertical surfaces of coke oven door refractory linings having different transverse dimensions. There are also provided cleaning tools for cleaning the inside vertical and horizontal surfaces of the door jamb which includes means to adjust the cleaning tools both horizontally and vertically so that the cleaning tools are arranged to clean door jambs having different vertical and transverse dimensions.

7 Claims, 12 Drawing Figures

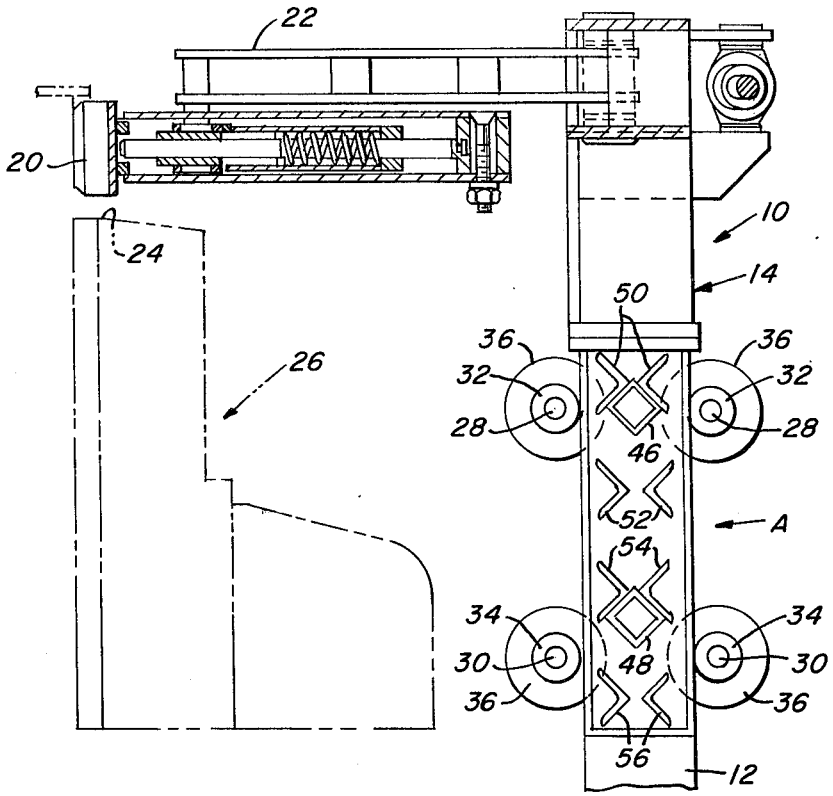
FIG. 1
FIG. 2
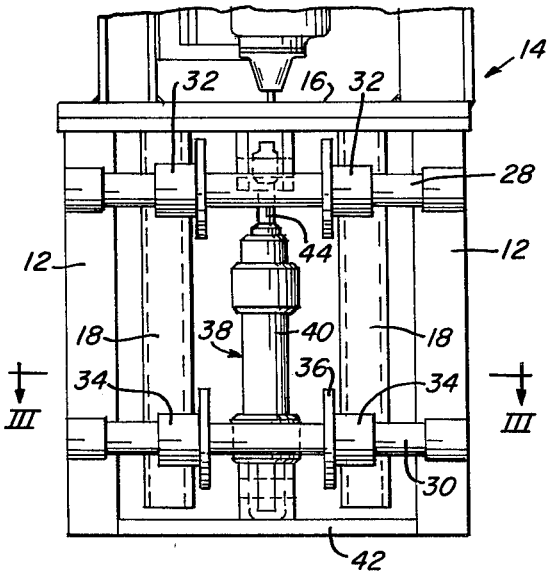
FIG. 3
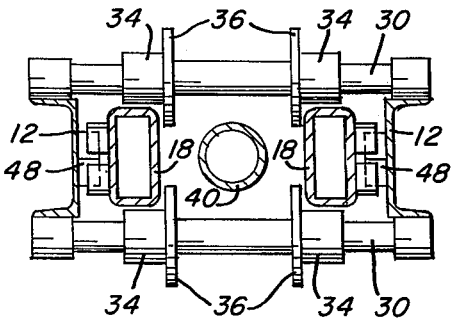

APPARATUS FOR CLEANING THE SEALING SURFACES OF COKE OVEN DOORS AND DOOR JAMBS

BACKGROUND OF THE INVENTION

1. Field of the Invention

This invention relates to apparatus for cleaning the sealing surfaces of doors and door jambs of coke oven chambers by means of reciprocally movable cleaning tools. More particularly, the invention relates to apparatus for cleaning the sealing surfaces of doors and door jambs of coke oven chambers that have different vertical and transverse dimensions.

2. Description of the Prior Art

Frequently the same coke oven battery has coke oven chambers with doors and door jambs of different vertical and transverse dimensions. In the past separate door and door jamb cleaning devices were provided for the different sized doors and door jambs. This required a plurality of door and door jamb cleaning devices for each coke oven battery.

There is a need for coke oven door and door jamb cleaning devices that are capable of cleaning coke oven doors and door jambs of different vertical and transverse dimensions.

SUMMARY OF THE INVENTION

The present invention solves the problem of providing door and door jamb cleaning apparatus that may be utilized with doors and door jambs having different dimensions. The coke oven door cleaning device includes a frame member with a support structure movably mounted thereon. A first cleaning tool is secured to the support structure and extends forwardly therefrom. The cleaning tool is arranged to move horizontally and clean the horizontal surface of the coke oven door. Means are provided to move the support structure mounted on the frame member vertically so that the first cleaning tool is operable to clean coke oven doors having different vertical dimensions. On the frame member there are also provided second cleaning tools for cleaning the vertical sealing edge surfaces of the coke oven door. The second cleaning tools are mounted on a rotary column which, in turn, is supported by the frame member. On the rotary column a plurality of tools are supported that extend outwardly therefrom at different distances from the rotary column. The rotary column is arranged to position one of the cleaning tools in abutting relation with the vertical surface of the coke oven door. The cleaning tool selected is dependent upon the width or transverse dimension of the coke oven door. There are also provided third cleaning tools to clean the vertical surfaces of the refractory lining. A plurality of refractory lining cleaning tools are mounted on a rotary column at different distances from the rotary column. Selection of the refractory lining cleaning tool is dependent on the width or transverse dimension of the refractory lining secured to the coke oven door.

There is also provided apparatus for cleaning the inside surface of the coke oven chamber and door jamb. The cleaning tools are secured to a tool holder which, in turn, is connected to a frame by means of a lever. The lever is adjustably mounted to adjust the transverse dimensions of the tool holder and thus the door jamb cleaning tools to permit the same door jamb tool holders to be used on door jambs of different dimensions.

Accordingly, the principal feature of this invention is to provide coke oven door and door jamb cleaning devices that are adjustable both vertically and horizontally to clean coke oven doors and door jambs having different vertical and/or transverse dimensions.

Another feature of this invention is to provide stop means for the cleaning tool arranged to clean the horizontal surface of the coke oven door.

These and other features and advantages of this invention will be more completely disclosed and described in the following specification, the accompanying drawings and the appended claims.

BRIEF DESCRIPTION OF THE DRAWINGS

FIG. 1 is a fragmentary vertical section through the apparatus for cleaning the horizontal sealing surface of coke oven doors.

FIG. 2 is a fragmentary view in elevation taken in the direction indicated by the arrow A, illustrating the actuating device to extend and retract the tool holder support structure illustrated in FIG. 1.

FIG. 3 is a view in section taken along the line III—III of FIG. 2.

DESCRIPTION OF THE PREFERRED EMBODIMENTS

Figure 4:
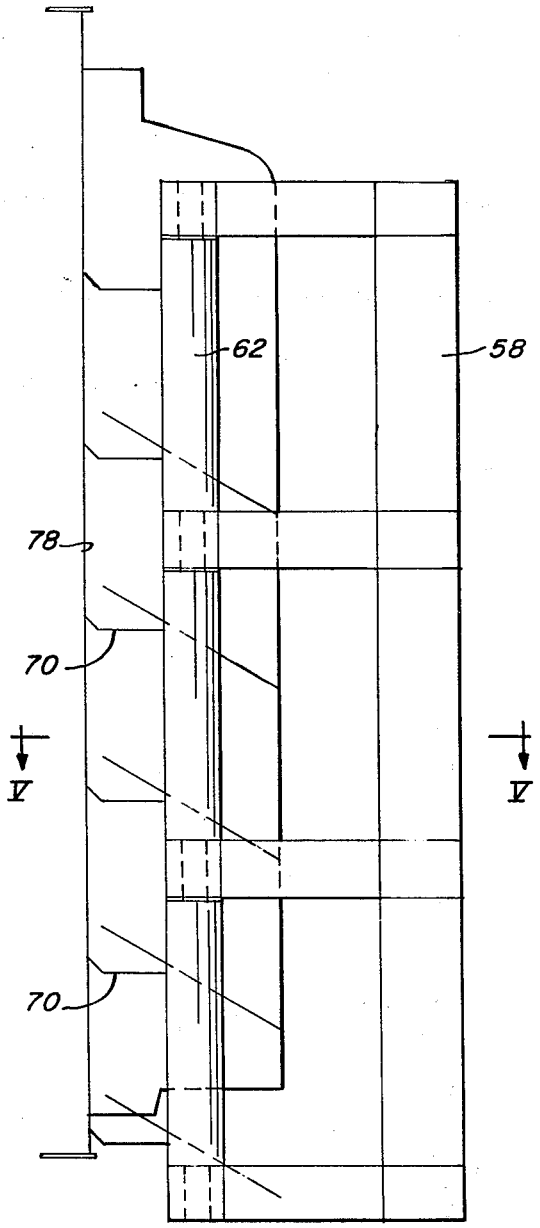
FIG. 4 is a diagrammatic fragmentary view in elevation of the apparatus for cleaning the vertical sealing surface of coke oven doors and the refractory linings of the coke oven doors.

Referring to the drawings and particularly FIGS. 1 – 3 there is illustrated coke oven door cleaning apparatus generally designated by the numeral 10 that includes a frame member 12 and a cleaning tool support member 14. The support member 14 includes an upper frame member 16 with a pair of generally rectangular depending members 18. Positioned on and extending forwardly from the upper frame member 16 is a cleaning tool 20 secured to an arm member 22. The cleaning tool 20 is arranged to be positioned in overlying relation with the upper horizontal surface 24 of coke oven door 26. The cleaning tool 20 is arranged to reciprocate in a horizontal plane and upon rotation remove the carbonaceous and tar deposits on the upper surface 24 of coke oven door 26. The cleaning tool 20 and arm member 22 may be constructed in a manner similar to the cleaning tool illustrated in U.S. Pat. No. 3,609,786.

Extending between and secured to the frame members 12 are pairs of shafts 28 and 30. Mounted on the shafts 28 and 30 are pairs of guide rolls 32 and 34 which abut the rectangular depending members 18 and permit controlled vertical movement of the support member 14. The guide rolls 32 and 34 have enlarged side guide portions 36 for the depending members 18.

A piston cylinder assembly 38 has the cylinder 40 secured to a transverse connecting member 42 of frame member 12 and the piston rod 44 connected to the upper frame member 16 of the cleaning tool support member 14. With this arrangement the extension and retraction of piston rod 44 within the cylinder 40 moves the cleaning tool support member 14 vertically relative to the frame member 12. As is illustrated in FIG. 1, the frame side members 12 have inwardly extending generally rectangular members 46 and 48 which serve as stop means to control the vertical position of the cleaning tool support member 14. The depending members 18 connected to the cleaning tool support member 14 have pairs of angularly shaped projections 50, 52, 54 and 56. The rectangular members 46 and 48 project inwardly from both of the vertical frame members 12 and the angularly shaped members 50 – 56 project outwardly from the depending members 18 as is illustrated in FIG. 3. With this arrangement the members 46 and 48 serve as stop means for the support member 14 by having the angularly shaped members 50 – 56 abut surfaces of the rectangular stop members 46 and 48. As illustrated in FIG. 1, the support member 14 is in a retracted position where surfaces of angular members 50 and 54 abut the rectangular members 46 and 48. As the piston extends from the cylinder 40 the angular members 52 move into abutting relation with the underside of the member 46 and the angular members 56 move into abutting relation with the underside of the member 48. With this arrangement the cleaning tool 20 may be positioned at two different and controlled elevations to abut the upper horizontal surface of the coke oven door 26. As illustrated in FIG. 1, the cleaning tool 20 is arranged to clean a coke oven door having a relatively small vertical dimension. Where it is desired to utilize the cleaning tool 20 to clean a coke oven door having a greater vertical dimension, the piston cylinder is actuated to move the support structure 14 upwardly so that the cleaning tool is at an elevation above the elevation illustrated in FIG. 1. A similar structure may be provided for the cleaning tool arranged to clean the lower horizontal surface of the coke oven door.

Figure 5:
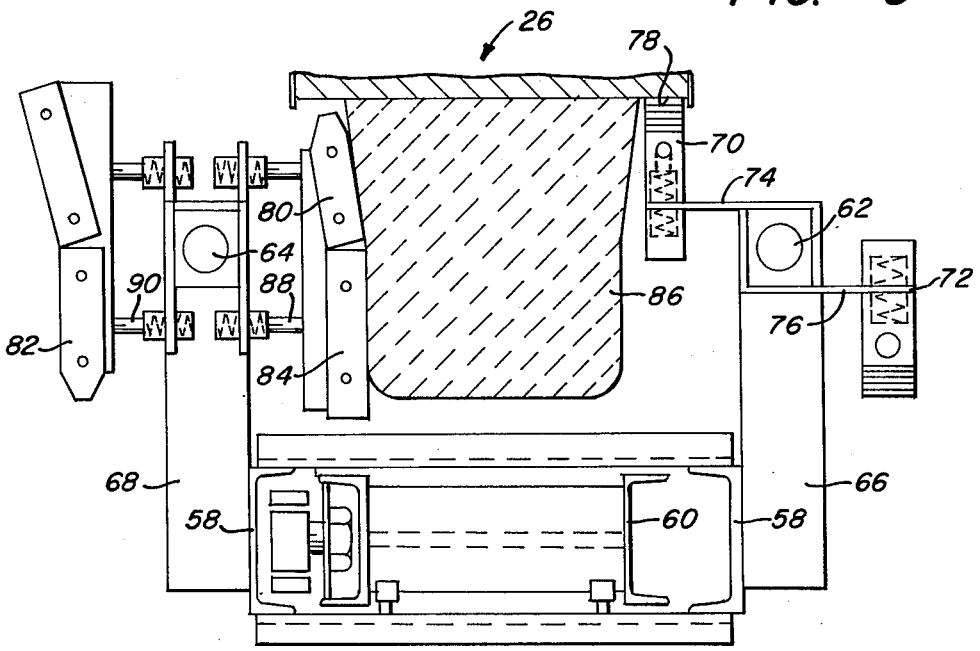
FIG. 5 is a top plan view in section taken along the line V—V of FIG. 4, illustrating the tools for cleaning the vertical sealing edges and the refractory lining of coke oven doors.

Referring to FIGS. 4 and 5, the apparatus for cleaning coke oven doors of different widths is illustrated and includes a frame 58 that is vertically movably mounted on a supporting frame 60 which is the same as the supporting frame 12. A pair of rotatable columns 62 and 64 are connected by means of arm members 66 and 68 to the frame member 58. The rotary column 62 has a pair of cleaning tools 70 and 72 connected thereto by means of arm members 74 and 76. The arm members 74 and 76 are of different lengths so that the cleaning tools 70 and 72 are arranged to clean the vertical edges 78 of coke oven doors having different widths. For example, where the coke oven door is relatively narrow the column 62 is rotated to position the cleaning tool 70 in the position illustrated in FIG. 5. The lever arm 74 being longer than lever arm 76 positions the cleaning tool 70 at a greater distance from the column 62 to thus clean vertical surfaces of relatively narrow coke oven doors. Where, on the other hand, the coke oven door has greater width than that illustrated in FIG. 5, the column 62 is rotated to position the cleaning tool 72 in abutting relation with the vertical surface of the wide coke oven door.

As diagrammatically illustrated in FIG. 4, the cleaning tool 70 is arranged to move vertically along the sealing surface 78 of the coke oven door to remove the carbonaceous deposits thereon. Any suitable means known may be provided to reciprocally move the cleaning tool 70 secured to the frame 58 as for example the frame 58 reciprocates vertically relative to the support frame 60.

Other sets of cleaning tools 70 and 72 are connected to the column 64 on the opposite side of the coke oven door to clean the other vertical surface of the coke oven door. The second set of cleaning tools are omitted from FIG. 5 to illustrate the cleaning tools for the refractory lining. Also, a similar set of cleaning tools for the refractory lining, as hereinafter described, are secured to the column 62 so that both the vertical sealing edges of the door and the side edges of the refractory lining may be simultaneously cleaned during the door cleaning operation. FIG. 4 diagrammatically illustrates the two sets of tools 70 and 80 on one side of the coke oven door 26.

Figure 9:
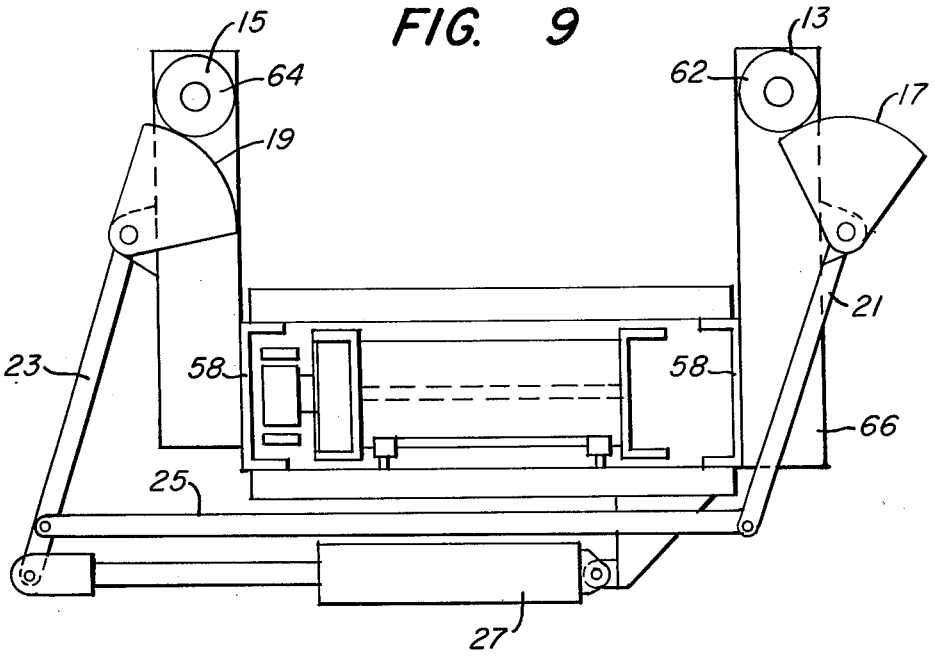
FIG. 9 is a top plan view of piston cylinder assembly to rotate the rotatable columns.

Referring to FIG. 5, a pair of refractory lining cleaning tools 80 and 82 are secured to the column 64 and are arranged to abut the side wall 84 of the coke oven door refractory lining 86. The arms 88 connecting the tools 80 have a different dimension than the arms 90 connecting the tools 82 to the column 64 so that the respective tools 80 and 82 may be arranged to clean the vertical surfaces of coke oven door refractory linings having different widths. The cleaning tools 70, 72, 80 and 82 are frictionally mounted by springs to compensate for uneven surfaces of the door or refractory lining. The respective tools 70, 72, 80 and 82 can be brought into operating position by rotating columns 62 and 64 by 180°. It is preferred that the tools are so rotated before the cleaning machine and door are moved toward each other. The columns are rotated and maintained in fixed position by a piston cylinder actuator illustrated in FIG. 9. The columns have gear portions 13 and 15 that mesh with gear segments 17 and 19. The segments 17 and 19 are pivotally secured to the arm members 66 and 68 and have the ends of levers 21 and 23 secured thereto. Levers 21 and 23 are in turn connected to each other adjacent their other end portion by a connecting lever 25 so that levers 21 and 23 remain parallel to each other. A piston cylinder assembly 27 is connected to the lever 23 and to the frame 58. With this arrangement the piston cylinder assembly rotates the columns 62 and 64 and maintains the columns in operative position.

Figure 6:
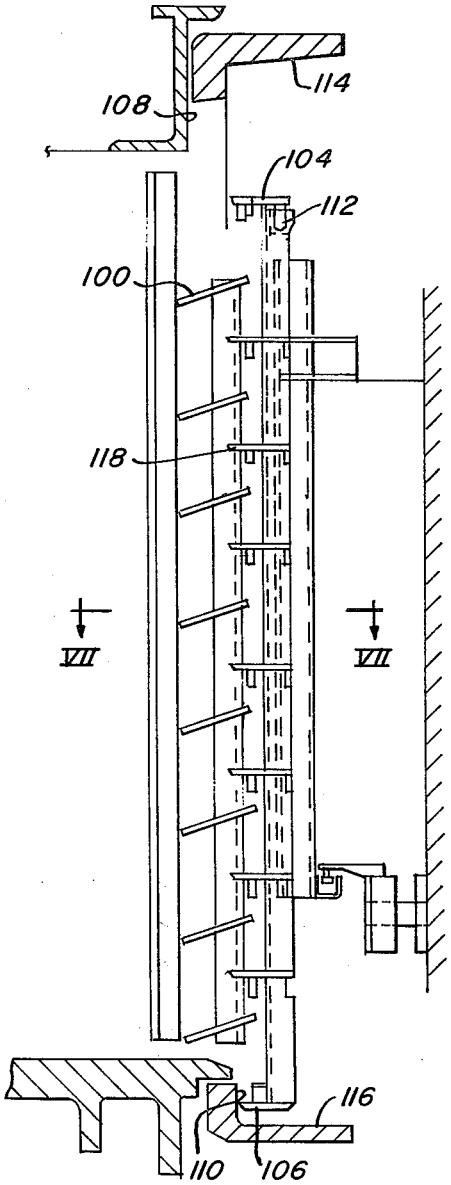
FIG. 6 is a view in side elevation of the apparatus for cleaning the sealing surfaces of the coke oven door jambs.
Figure 7:
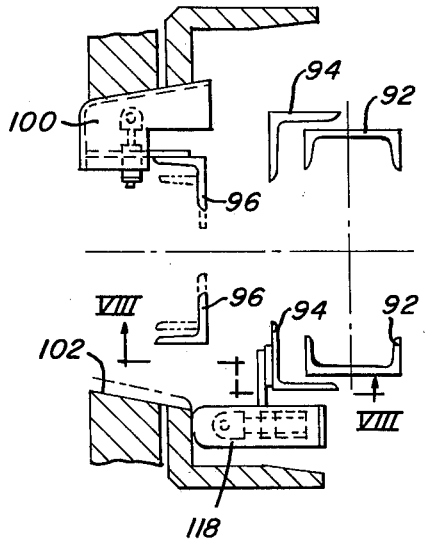
FIG. 7 is a fragmentary top plan view in section taken along the line VII—VII of FIG. 6.
Figure 8:
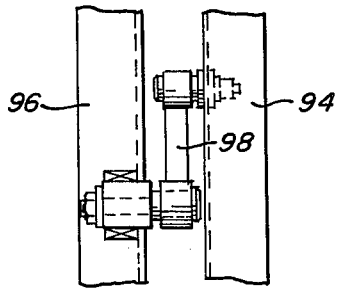
FIG. 8 is a fragmentary view in elevation taken along the line VIII—VIII of FIG. 7.
Figure 10:
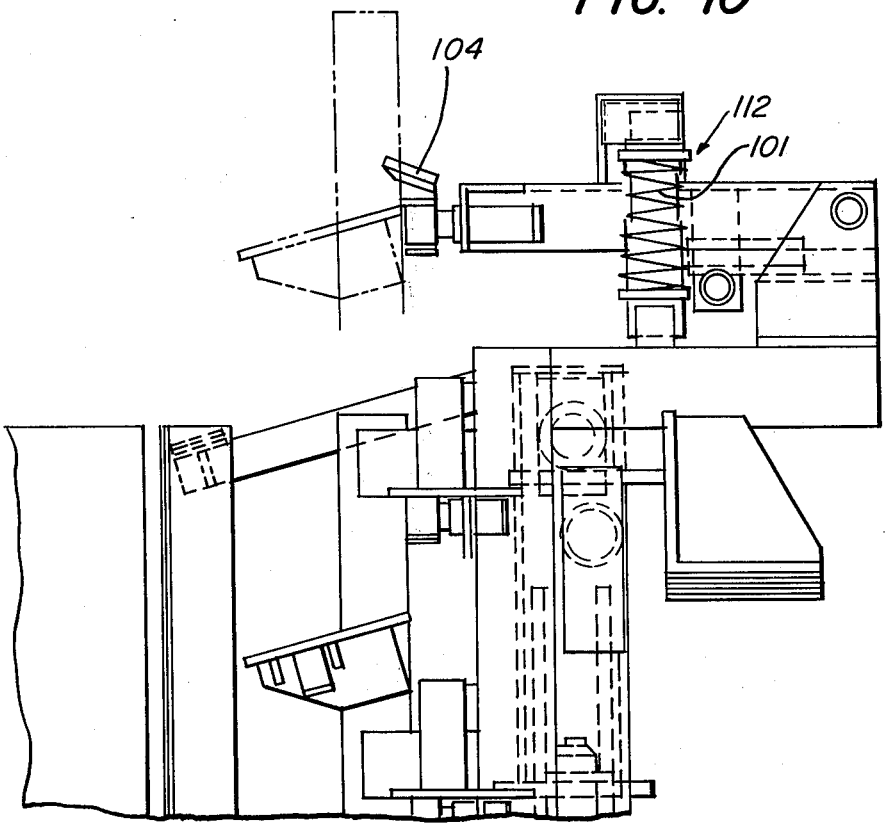
FIG. 10 is an enlarged fragmentary view of the upper portion of FIG. 6 illustrating the manner in which the tool for cleaning the upper door jamb is supported.
Figure 11:
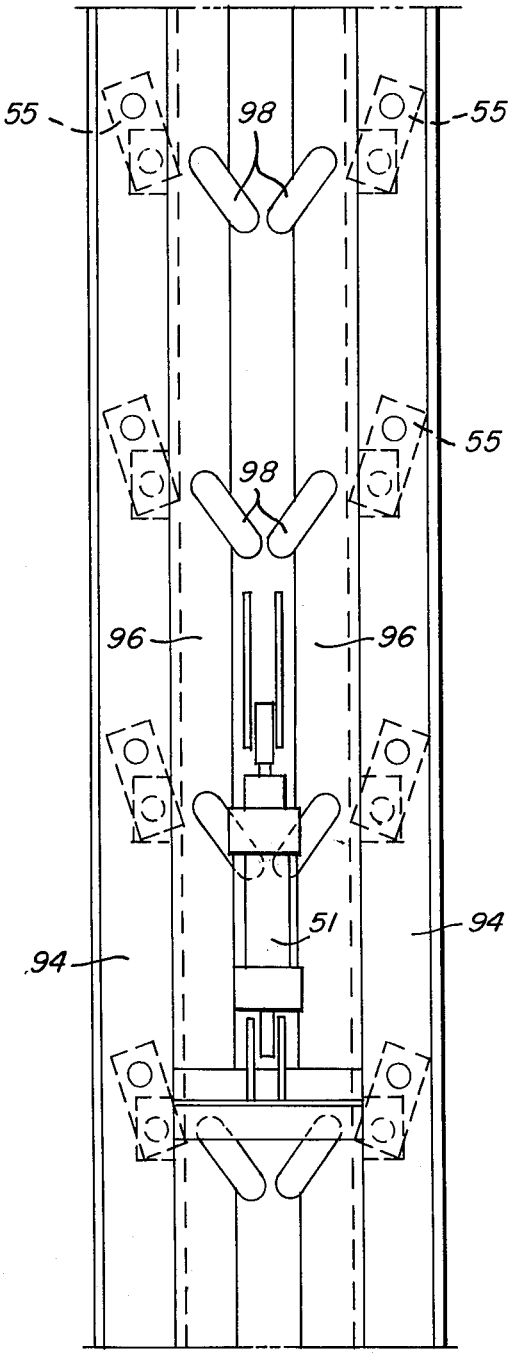
FIG. 11 is a view in rear elevation of the apparatus for cleaning the sealing surfaces of the door jamb diagrammatically illustrated in FIG. 6.
Figure 12:
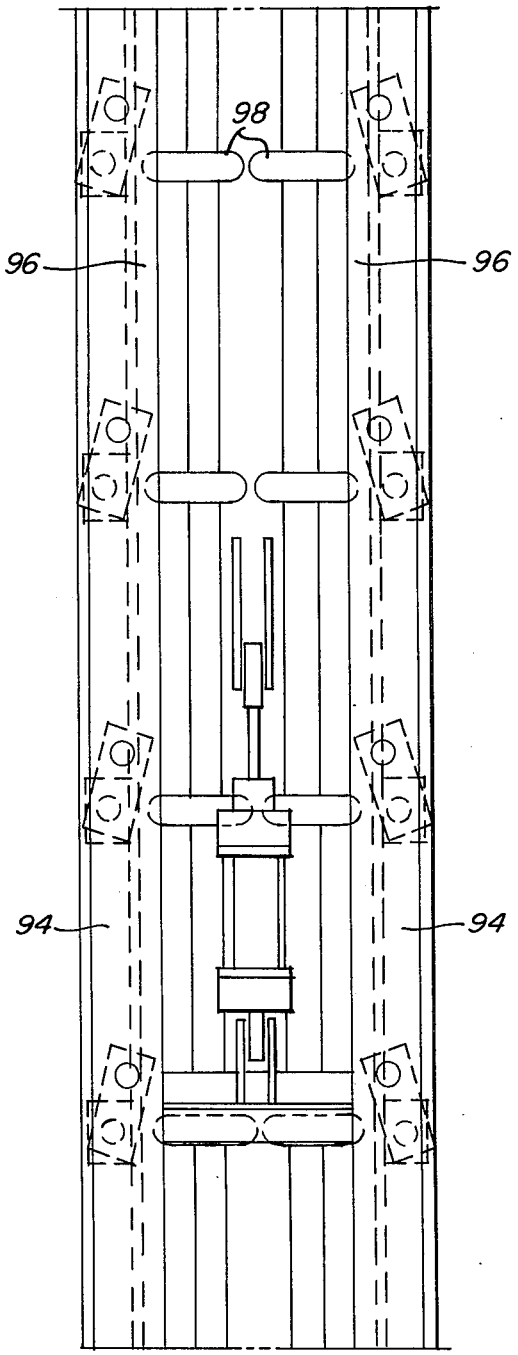
FIG. 12 is a view similar to FIG. 11 illustrating the tool holders in an extended position.

The cleaning apparatus for the door jambs is illustrated in FIGS. 6 – 8. A frame 92 is fastened on the transportable supporting frame similar to the frame 12 and frame 94 of the tool holder is vertically movably mounted on frame 92. Cleaning tools 118 are supported on frame 94 and are arranged to clean sealing surfaces 120. Additional tool holders 96 are fastened to the frame 94 by arms 98. The arms 98 are pivotally secured to the frame 94 and tool holder 96. Cleaning tools 100 for the inside surfaces 102 of the coke oven chamber are arranged on the tool holders 96. The cleaning tools are, in turn, flexibly mounted by means of springs. Where the cleaning apparatus is installed in a relatively narrow frame, as illustrated in broken lines in FIG. 7, the tool holders 96 can be moved toward one another by crank gears, guide rolls or similar apparatus. The drive for the tool holders and the apparatus for moving the holders 96 outwardly or inwardly can be effected either hydraulically, pneumatically, electrically or mechanically. FIGS. 11 and 12 illustrate the manner that the holders 96 are moved inwardly and outwardly. A piston cylinder assembly 51 is connected to a strap 53 secured to frame 94 and the piston 53 is connected to the holders 96. When the piston is retracted as illustrated in FIG. 11, the holders 94 are moved into the inner position illustrated in phantom in FIG. 7. When the piston 53 is extended the holders 94 move outwardly as illustrated in FIG. 12. Cleaning tools 104 and 106 are provided for the top and bottom horizontal sealing surfaces 108 and 110, respectively. For adaptation to different oven height the cleaning tools 104 and 106 are vertically flexibly arranged at 112 by means of a spring 101 mounted on a rod 103 as illustrated in FIG. 10. The vertical stroke of the cleaning tools 104 and 106 is limited by the stops 114 and 116 on the coke oven door jambs.

With the previously described apparatus it is now possible with the same apparatus to clean the sealing surfaces of coke oven doors and coke oven door refractory linings where the coke oven doors have different vertical and transverse dimensions without using separate door cleaning devices. Further, it is now possible to clean the sealing surfaces of coke oven door jambs having different vertical and transverse dimensions.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Apparatus for cleaning the sealing surface of coke oven doors comprising, a frame member, a support structure movably mounted on said frame member, a cleaning tool secured to said support structure and extending forwardly therefrom, said cleaning tool arranged to move horizontally and clean a horizontal surface of a coke oven door, means to move said support structure vertically so that said cleaning tool is operable to be positioned to clean coke oven doors of different vertical dimensions, a second frame member movable vertically relative to said first frame member, said second frame member having a support member extending forwardly therefrom, a rotary column secured to said support member extending forwardly from said second frame member, pairs of second cleaning tools secured to said rotary column and extending outwardly therefrom, said second cleaning tools spaced at different dimensions from said rotary column, and said second cleaning tools operable to move vertically and selectively clean the vertical sealing surface of coke oven doors having different transverse dimensions.

2. Apparatus for cleaning the sealing surface of coke oven doors as set forth in claim 1 which includes, stop means secured to said support structure and said frame member to limit the upper and lower adjusted positions of said cleaning tool.

3. Apparatus for cleaning the sealing surface of coke oven doors as set forth in claim 2 in which, said stop means includes pairs of rectangular stop members secured to vertical portions of said frame member, pairs of upper abutment members arranged to abut the upper portion of said stop means when said support structure is in a retracted position, and a pair of lower abutment members arranged to abut the lower portion of said stop means when said support structure is in an extended position.

4. Apparatus for cleaning the sealing surface of coke oven doors as set forth in claim 1 which includes, arm members connecting said second cleaning tools to said rotary column, said arm members having different lengths to position said second cleaning tools at preselected distances from said rotary column to thereby clean the vertical sealing surface of coke oven doors having different transverse dimensions.

5. Apparatus for cleaning the sealing surface of coke oven doors comprising, a frame member, a support structure movably mounted on said frame member, a cleaning tool secured to said support structure and extending forwardly therefrom, said cleaning tool arranged to move horizontally and clean a horizontal surface of a coke oven door, means to move said support structure vertically so that said cleaning tool is operable to be positioned to clean coke oven doors of different vertical dimensions, a second frame member movable vertically relative to said first frame member, said second frame member having a support member extending forwardly therefrom, a rotary column secured to said support member extending forwardly from said second frame member, pairs of third cleaning tools secured to said rotary column and extending outwardly therefrom, said third cleaning tools spaced at different dimensions from said rotary column, said third cleaning tools operable to move vertically to selectively clean the side surface of said coke oven door refractory lining.

6. Apparatus for cleaning the sealing surface of coke oven doors as set forth in claim 5 which includes, stop means secured to said support structure and said frame member to limit the upper and lower adjusted positions of said cleaning tool.

7. Apparatus for cleaning the sealing surface of coke oven doors as set forth in claim 6 in which, said stop means includes pairs of rectangular stop members secured to vertical portions of said frame member, pairs of upper abutment members arranged to abut the upper portion of said stop means when said support structure is in a retracted position, and a pair of lower abutment members arranged to abut the lower portion of said stop means when said support structure is in an extended position.

* * * * *